US010756486B2

(12) United States Patent
Houry et al.

(10) Patent No.: US 10,756,486 B2
(45) Date of Patent: Aug. 25, 2020

(54) MATING ASSISTANCE DEVICE FOR ELECTRICAL CONNECTORS

(71) Applicant: Connecteurs Electriques Deutsch, Evreux (FR)

(72) Inventors: Laurent Houry, Le Roncenay-Authenay (FR); Thierry Cassar, Angerville La Campagne (FR); Christian Cavailles, Oceanside, CA (US)

(73) Assignee: Connecteurs Electriques Deutsch, Evreux (FR)

( * ) Notice: Subject to any disclaimer, the term of this patent is extended or adjusted under 35 U.S.C. 154(b) by 0 days.

(21) Appl. No.: 16/380,246

(22) Filed: Apr. 10, 2019

(65) Prior Publication Data

US 2019/0312386 A1 Oct. 10, 2019

(30) Foreign Application Priority Data

Apr. 10, 2018 (EP) ..... 18305421

(51) Int. Cl.
*H01R 13/631* (2006.01)
*H01R 13/633* (2006.01)
*H01R 13/629* (2006.01)

(52) U.S. Cl.
CPC ..... *H01R 13/631* (2013.01); *H01R 13/62911* (2013.01); *H01R 13/6335* (2013.01)

(58) Field of Classification Search
CPC ..... H01R 13/4361; H01R 13/639; H01R 13/4362; H01R 13/631; H01R 13/6335; H01R 13/62911
USPC ..... 439/347, 752
See application file for complete search history.

(56) References Cited

U.S. PATENT DOCUMENTS 5,433,619 A * 7/1995 Maejima ..... H01R 13/62933 439/157
5,454,737 A * 10/1995 Saba ..... H01R 13/743 439/350
5,899,762 A * 5/1999 Ainceri ..... H01R 13/62905 439/157
6,244,880 B1 * 6/2001 Fukase ..... H01R 13/62911 439/157
6,890,194 B2 * 5/2005 Katsuma ..... H01R 13/62905 439/157

(Continued)

FOREIGN PATENT DOCUMENTS

JP 0584061 U 11/1993
JP 2003031305 A 1/2003
WO 9711515 A1 3/1997

OTHER PUBLICATIONS

Extended European Search Report, Application No. 18305421.2. dated Sep. 28, 2018, 8 pages.

(Continued)

*Primary Examiner* — Hien D Vu
(74) *Attorney, Agent, or Firm* — Barley Snyder

(57) ABSTRACT

A mating assistance device comprises a housing having an opening receiving an electrical connector in a direction of insertion and a locking device movable between an unlocked position and a locked position with respect to the housing. The locking device has a connector pushing element displaceable in the direction of insertion when the locking device moves from the unlocked position to the locked position.

17 Claims, 6 Drawing Sheets

(56) References Cited

U.S. PATENT DOCUMENTS

| | | | | |
|---|---|---|---|---|
| 7,497,706 | B2 * | 3/2009 | Daudin | H01R 13/514<br>439/157 |
| 8,992,240 | B2 * | 3/2015 | Shiga | H01R 13/62911<br>439/157 |
| 2014/0242829 | A1 | 8/2014 | Brodsky et al. | |

OTHER PUBLICATIONS

Machine translation of JP2003031305, dated Jan. 31, 2003, 8 pages.

* cited by examiner

MATING ASSISTANCE DEVICE FOR ELECTRICAL CONNECTORS

CROSS-REFERENCE TO RELATED APPLICATION

This application claims the benefit of the filing date under 35 U.S.C. § 119(a)-(d) of European Patent Application No. 18305421.2, filed on Apr. 10, 2018.

FIELD OF THE INVENTION

The present invention relates to electrical connectors and, more particularly, to a mating assistance device for electrical connectors.

BACKGROUND

Electrical connector assemblies used for cabins in commercial aerospace and other applications often comprise separate connectors that mate together to form a secure physical and electrical connection. The electrical connector assemblies for aerospace applications, in particular, must also meet altitude immersion requirements.

To achieve an effective, properly aligned, and sealed electrical connection of the connectors, it is common to employ a mating assistance device for connecting the electrical connectors together. The mating assistance devices are usually made of several parts which are assembled by screwing, welding, and/or bonding when the connection between the connectors is achieved. Consequently, the mating assistance devices require the use of additional tools, such as a screwdriver, for the assembly. Furthermore, the mating assistance devices, commonly provided with machined parts, are costly to produce, and are also not sufficiently light for the reduced weight requirements of cabins in commercial aerospace applications.

SUMMARY

A mating assistance device comprises a housing having an opening receiving an electrical connector in a direction of insertion and a locking device movable between an unlocked position and a locked position with respect to the housing. The locking device has a connector pushing element displaceable in the direction of insertion when the locking device moves from the unlocked position to the locked position.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
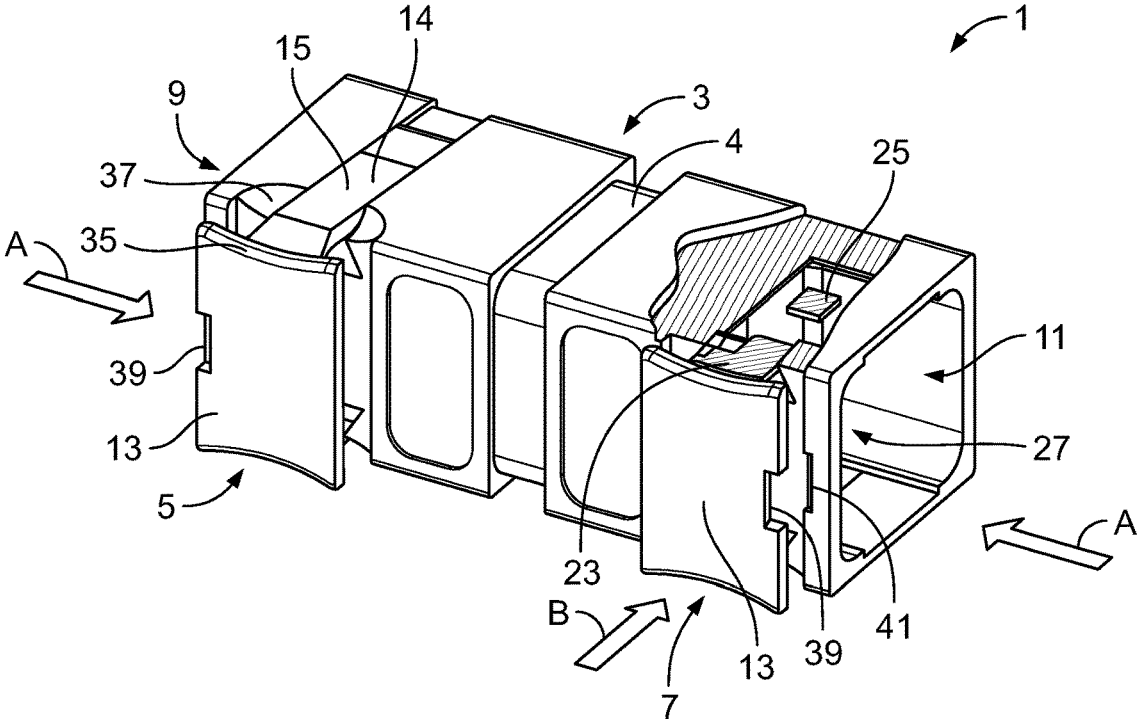
FIG. 1 is a perspective view of a mating assistance device according to an embodiment.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will convey the concept of the disclosure to those skilled in the art. Various structures, systems and devices are schematically depicted in the drawings for purposes of explanation only and so as to not obscure the present disclosure. The words and phrases used herein should be understood and interpreted to have a meaning consistent with the understanding of those words and phrases by those skilled in the relevant art.

Figure 2:
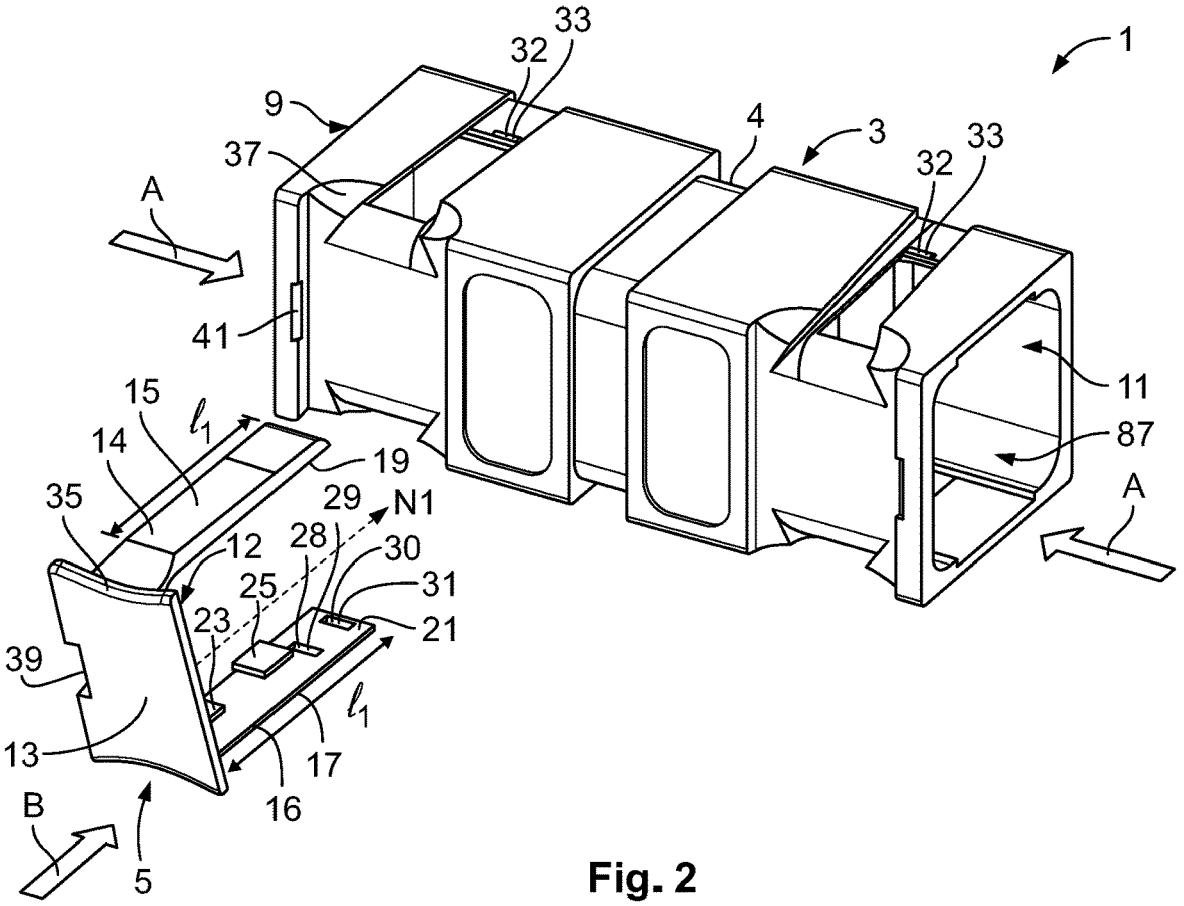
FIG. 2 is an exploded perspective view of the mating assistance device.

A mating assistance device 1 according to the invention is shown in FIGS. 1 and 2. The mating assistance device 1 comprises a housing 3 and a pair of locking devices 5, 7 movable with respect to the housing 3. The locking devices 5, 7 are shown in an unlocked position relative to the housing 3 in FIG. 1.

The housing 3, shown in FIGS. 1 and 2, is monolithically formed in a single piece of a molded plastic or a polymer material. In the shown embodiment, the housing 3 has the shape of a hollow beam with a pair of opened ends 9, 11. The opened ends 9, 11 are each adapted to receive a terminal of an electrical connector in a direction of insertion A. In another embodiment, a center region 4 of the housing 3 has a plurality of flanges or a flange receiving region.

Figure 3:
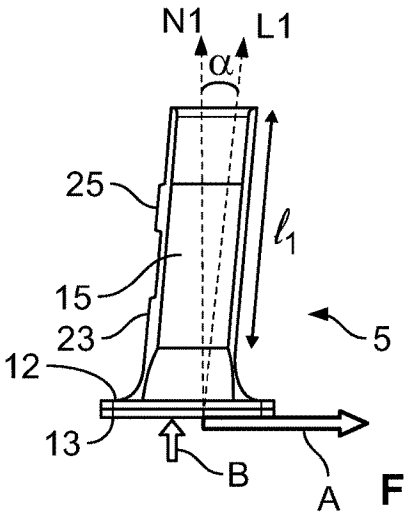
FIG. 3 is a top view of a locking device of the mating assistance device.

The locking devices 5, 7, shown in FIGS. 1-3, are identical and are mounted on the housing 3 with mirror symmetry with respect to the center region 4. In another embodiment, the locking devices 5, 7 may be different from each other. Each locking device 5, 7 has the form of a U-shaped bracket having a complementary shape to the housing 3. Each U-shaped locking device 5, 7 has a central portion 13 having an inner surface 12 from which extends a pair of arms 14, 16 providing respectively a pair of connector pushing elements 15, 17. The central portion 13 of each locking device 5, 7 can be used as a pushing surface by an operator for moving the locking devices 5, 7 from the unlocked position to a locked position in a locking direction B. The locking direction B is perpendicular to the direction of insertion A. The locking devices 5, 7 are referred to herein as a first locking device 5 and a second locking device 7. When using a bracket for the locking device 5, 7, the force can be applied on two sides of the electrical connector and in addition, the same shape of locking device 5, 7 can be used on the left and the right side of the housing 3 when connecting two electrical connectors.

As shown in FIG. 3, a direction L1 of a length 11 of each arm 14, 16, and accordingly of each connector pushing element 15, 17, is angled with respect to a direction N1 extending normally from the inner surface 12 of the central portion 13. In an embodiment, the inclination between the direction L1 and the direction N1 forms an angle α between 5° and 15°. The direction N1 of the normal extending from the inner surface 12 of the central portion 13 of the locking device 5 and the locking direction B are parallel, as shown in FIG. 2. The direction L1 of the length 11 of the connector pushing element 15, 17 is inclined with respect to the locking direction B with the angle α. Therefore, the trajectory of each connector pushing element 15, 17 from the unlocked position to the locked position is inclined with respect to the locking direction B according to the angle α.

The first locking device 5 is mounted on the housing 3 such that, when the first locking device 5 moves from the unlocked position to the locking position in the locking direction B, the inclination of the connector pushing elements 15, 17 forming the angle α is oriented towards the center region 4 of the housing 3. As a consequence, the inclination of the connector pushing elements 15, 17 moves and compresses each electrical connector towards the center region 4 of the housing 3 for sealing the electrical connectors together when inserted into the housing 3. In an embodiment, the altitude immersion requirement can thus be satisfied. The same applies for the second locking device 7.

The connector pushing elements 15, 17 of each locking device 5, 7, as shown in FIG. 2, have inner surfaces 19, 21 facing each other. The surfaces 19, 21 of the connector pushing elements 15, 17 each have a pair of protrusions 23, 25 protruding towards an inside 27 of the housing 3 when the locking devices 5, 7 are mounted to the housing 3. The shapes of the first and second protrusions 23, 25 of the locking devices 5, 7 are complementary to an interface of an electrical connector, described in greater detail below with reference to FIG. 4*b*.

The mating assistance device 1, as shown in FIG. 2, has a plurality of retention devices 28, 30, 32 configured to hold the locking device 5, 7 in the unlocked position and in the locked position respectively relative to the housing 3. A pair of pushing retention devices 28, 30 of each connector pushing element 15, 17 are longitudinal grooves 29, 31 provided on the surface 19, 21. The longitudinal grooves 29, 31 are dimensioned to engage a protruding element 33 of a housing retention device 32 of the housing 3, the protruding element 33 protruding towards the connector pushing element 15, 17. The retention devices 28, 30, 32 are configured to provide a form-fit connection between the housing 3 and each of the connector pushing elements 15, 17 in the unlocked position and in the locked position, preventing involuntary locking or unlocking of the locking devices 5, 7. In the unlocked position, as shown in FIG. 1, the locking device 5, 7 is held by form-fit connection between the first longitudinal groove 31 and the protruding element 33 of the housing 3. In the locked position, the locking device 5, 7 is held by form-fit connection between the second longitudinal groove 29 and the protruding element 33 of the housing 3.

Each locking device 5, 7 and the housing 3 respectively have a handle 35, 37 for pulling the locking device 5, 7 from the locked position to the unlocked position. Hence, the mating of the electrical connectors can be reversed, therefore allowing an easy versatile use in comparison with a soldered or a bonded assembly which has to be destroyed to disassemble. Each locking device 5, 7 and the housing 3 has an opening with an undercut 39, 41 configured to allow an unmating of the electrical connectors, in particular by using an external tool.

The successive steps of the method for connecting electrical connectors with the mating assistance device 1 according to the invention are shown in FIGS. 4-7*b* and will be described in greater detail below.

Figure 4:
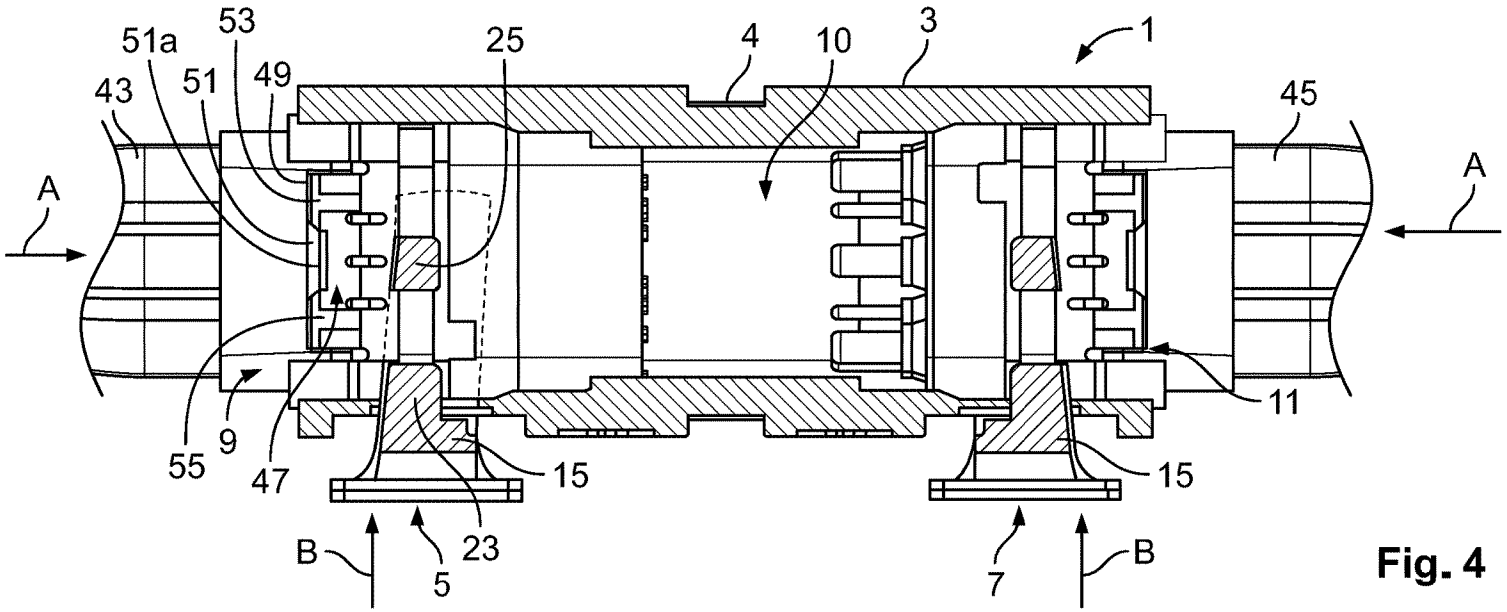
FIG. 4 is sectional top view of the mating assistance device with a pair of electrical connectors in an unlocked position.
Figure 4A:
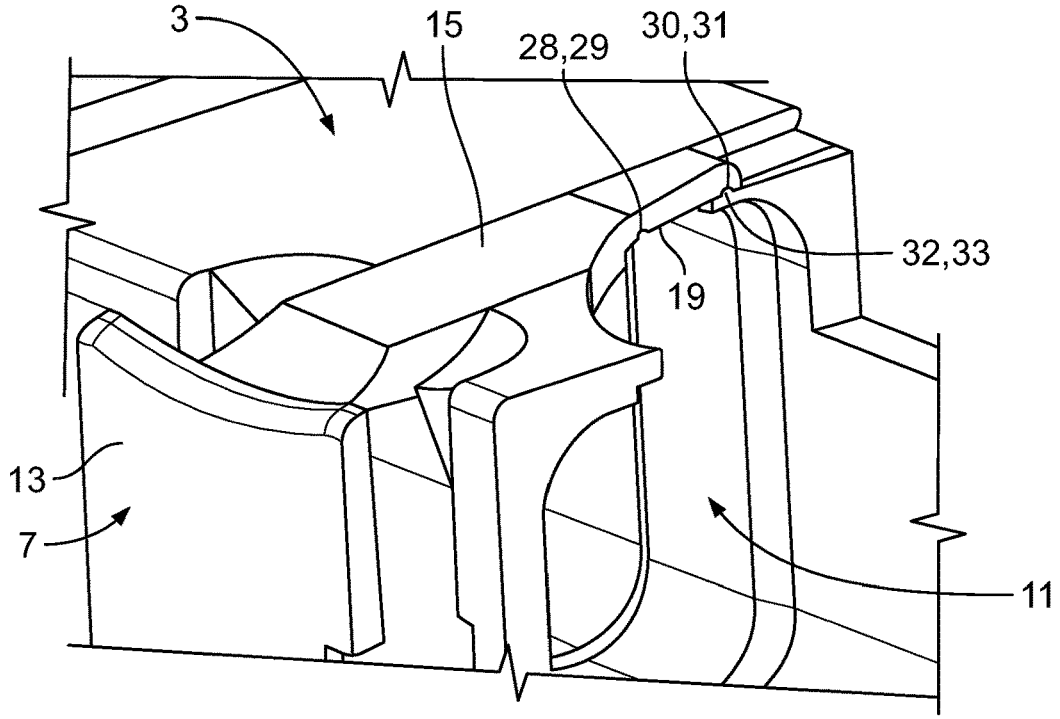
FIG. 4*a* is a sectional perspective view of a plurality of retention devices of the mating assistance device in the unlocked position.

FIG. 4 shows a state wherein a pair of electrical connectors 43, 45 have been partially introduced into the mating assistance device 1 and the locking devices 5, 7 are in the unlocked position, as also shown in FIG. 4*a*. The electrical connectors 43, 45 are inserted into the housing 3 of the mating assistance device 1 at the opened ends 9, 11 in the direction of insertion A. In the state shown in FIG. 4, the electrical connectors 43, 45 are not yet in contact and are separated by air 10 inside the housing 3. The locking device 7 is held in the unlocked position by form-fit connection between the first longitudinal groove 31 of the connector pushing element 15 and the protruding element 33 of the housing 3.

Figure 4B:
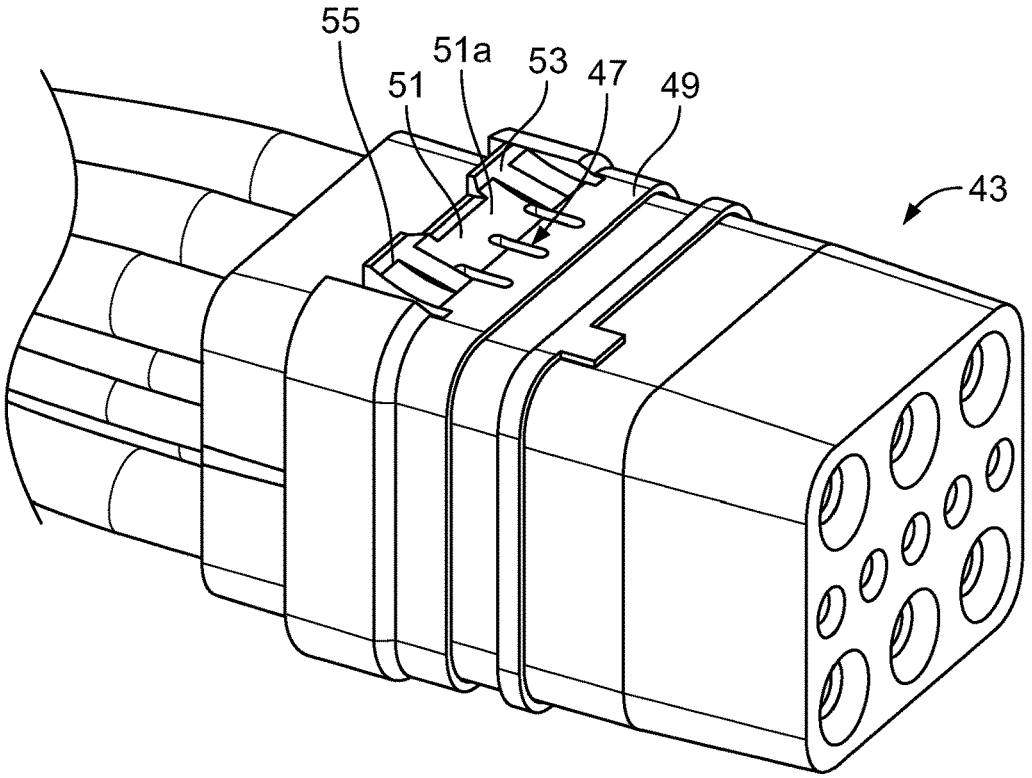
FIG. 4*b* is a perspective view of an electrical connector of the pair of electrical connectors.

As shown in FIG. 4*b*, each electrical connector 43, 45 has a latch device 47 on an interface 49. The latch device 47 includes a ramp 51 and a pair of protrusions 53, 55 in the form of wedges 53, 55 adjacent each side of the ramp 51 perpendicular to a slope 51*a* of the ramp 51.

Figure 5:
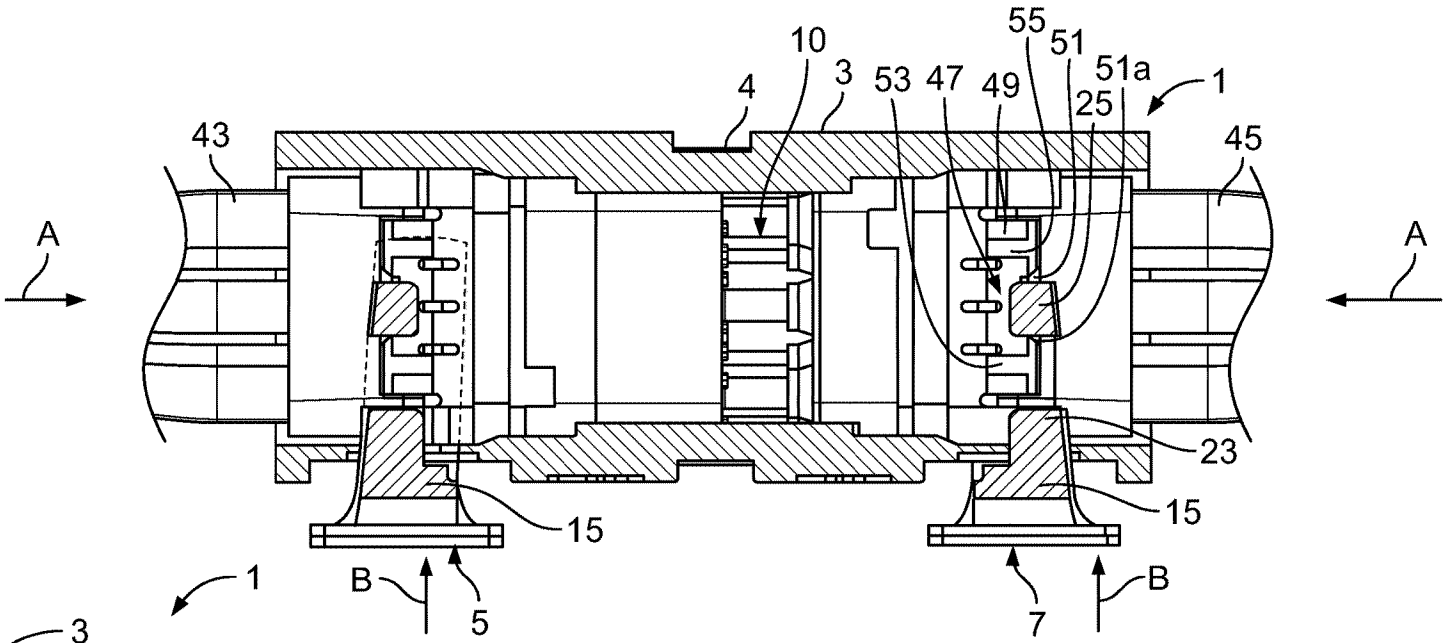
FIG. 5 is a sectional top view of the mating assistance device with the pair of electrical connectors and the locking devices of the mating assistance device in the unlocked position.

In FIG. 5, the electrical connectors 43, 45 have been further inserted into the housing 3 such that they are now in contact with each other. Consequently, the air volume 10 is reduced compared to FIG. 4. The locking devices 5, 7 are still in an unlocked position. The displacement of the electrical connectors 43, 45 in the insertion direction A has moved the latch device 47 such that the second protrusion 25 of the connector pushing element 15 slides over the surface of interface 49 and is guided to the ramp 51. The dimensions of the first and second protrusions 23, 25 are adapted with respect to the dimensions of the latch device 47 of the electrical connectors 43, 45.

Figure 5A:
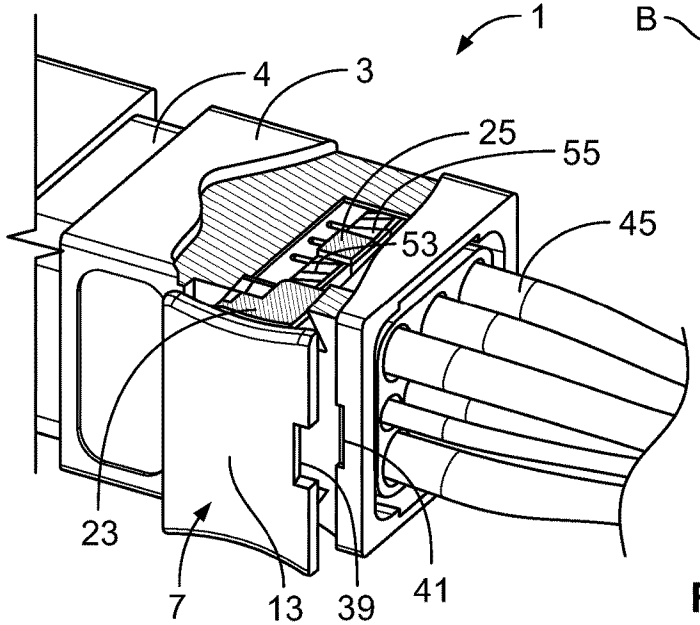
FIG. 5*a* is a sectional perspective view of the mating assistance device in the unlocked position.

As shown in FIG. 5*a*, the second protrusion 25 is then positioned between the wedges 53, 55 of the latch device 47. In this configuration, the locking device 5, 7 cannot be moved into the locked position in the locking direction B, as the first and second protrusions 23, 25 are blocked by the wedges 53, 55.

Figure 6:
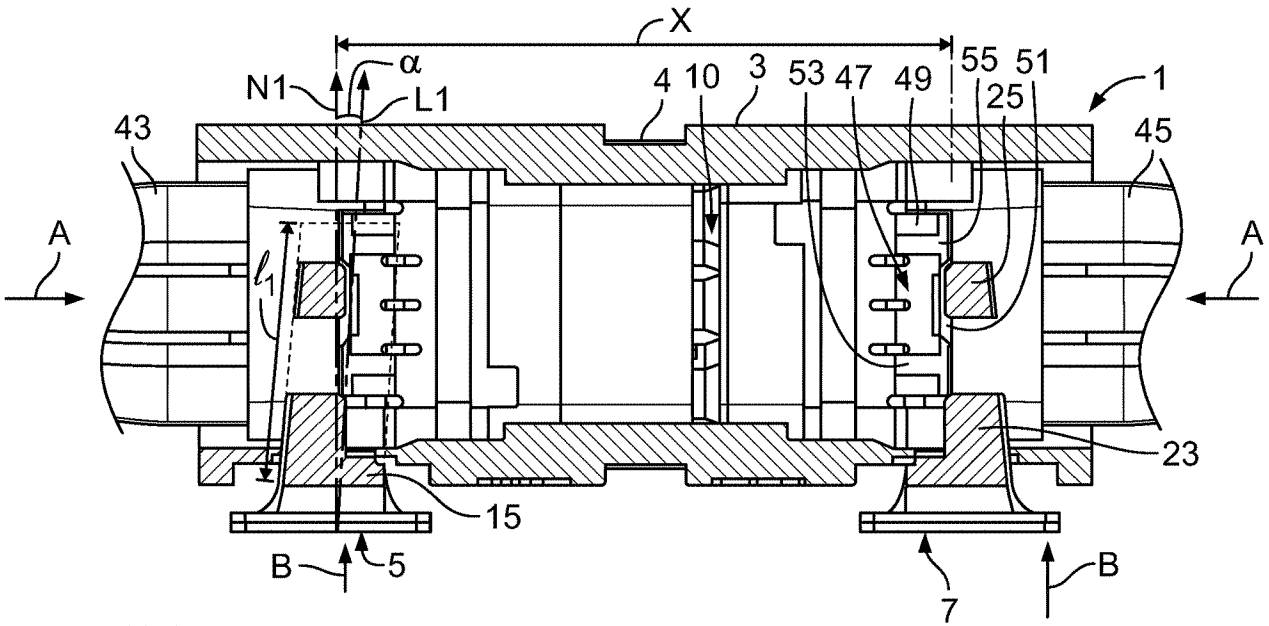
FIG. 6 is a sectional top view of the mating assistance device with the pair of electrical connectors and the locking devices partially moved from the unlocked position to a locked position.

In a step shown in FIG. 6, the electrical connectors 43, 45 have been further inserted into the housing 3 in the direction of insertion A by pushing the locking devices 5, 7 in the locking direction B. The air gap 10 is further reduced in comparison to the state shown in FIG. 5. The second protrusion 25 of the connector pushing element 15 slides further and partially behind the wedges 53, 55 on the side of the opened ends 9, 11 of the housing 3. By applying a force in the locking direction B on the central portion 13 of the locking devices 5, 7, the connectors 43 and 45 can be moved closer together without the need of an external tool.

The inclination of the direction L1 of the connector pushing element 15 with respect to the locking direction B allows a displacement of the connector pushing element 15 in the direction of insertion A when the locking device 5, 7 is moved from the unlocked to the locked position. According to this embodiment, the trajectory of the connector pushing element 15 from the unlocked position to the locked position is inclined with respect to the locking direction B, at an angle α between 5° and 15°. The inclination of the connector pushing elements 15, 17 of each locking devices 5, 7 are oriented towards the center region 4 of the housing 3 with respect to the normal direction N1 and the locking direction B. As a consequence, the inclination of the connector pushing elements 15, 17 provides the effect of moving each electrical connector 43, 45 towards the center region 4 of the housing 3 by the protrusions 23, 25 so that they can be compressed together to achieve the desired sealing. Indeed, the inclined trajectory of the protrusions 23, 25 with respect to the normal direction N1 and the locking direction B, have the effect of compressing the electrical connectors 43, 45 inwards in the housing 3. At the step shown in FIG. 6, the latch device 47 of each electrical connector 43, 45 is separated by a distance X.

Figure 7:
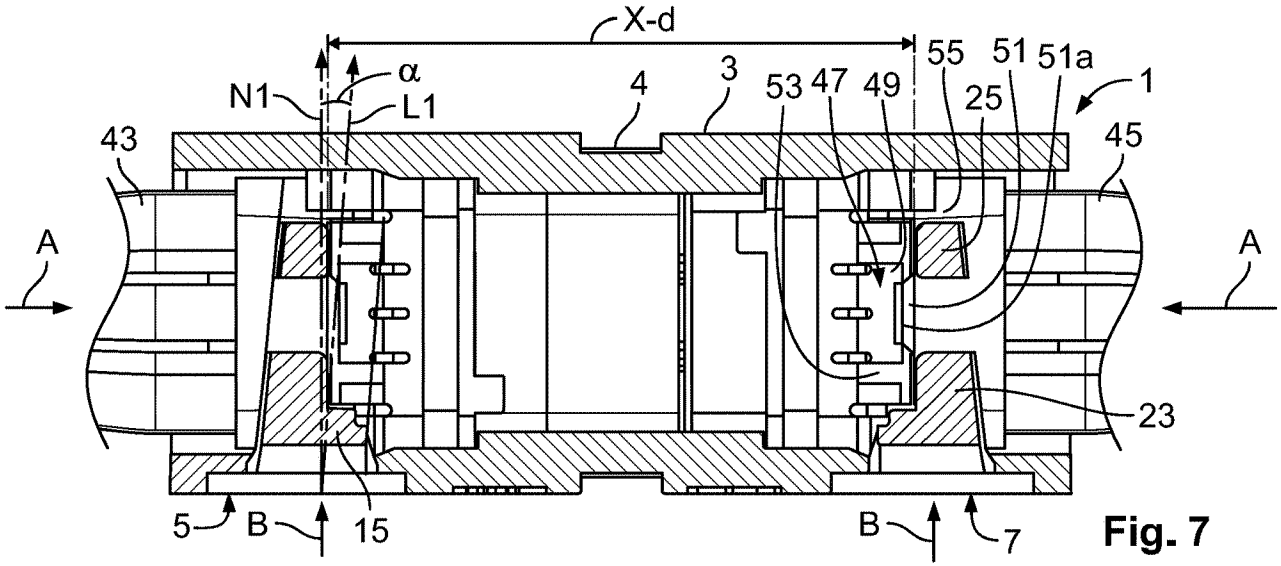
FIG. 7 is a sectional top view of the mating assistance device with the pair of electrical connectors and the locking devices in the locked position.

FIG. 7 shows a state in which the electrical connectors 43, 45 are mated and the locking devices 5, 7 are in their locked position. By pressing on the central portion 13, shown in FIG. 7*a*, of the locking devices 5, 7 in the locking direction B, the locking devices 5, 7 can be moved into the housing 3 such that the electrical connectors 43, 45 are mated together. A small volume of air 10 remains between the connectors 43 and 45. Only a plurality of elastomeric sealing cone devices of the male connector 45 are compressed into the a plurality of opposite cone recesses of the female connector 43. In comparison with the step shown in FIG. 6, in FIG. 7 the latch devices 47 of each electrical connector 43, 45 are now separated by a distance X-d, the distance d corresponding to the necessary dimension for having an efficient sealing between the two electrical connectors 43, 45. The first and second protrusions 23, 25 are positioned behind the wedges 53, 55 on the interface 49. Thanks to the complementary shapes of the wedges 53, 55 and the protrusions 23, 25; the connector pushing elements 15, 17 and the latch devices 47 realize a form-fit connection. As a result, the electrical connector 43, 45 cannot move against the direction A as it abuts against protrusions 23 and 25.

Figure 7A:
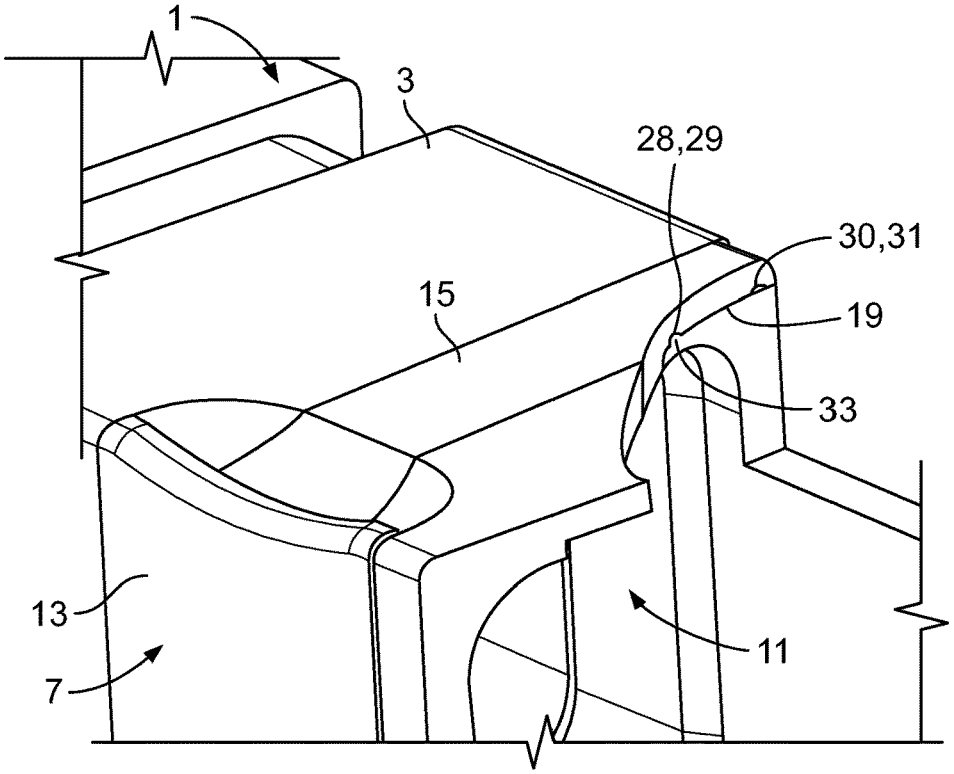
FIG. 7*a* is a sectional perspective view of the mating assistance device in the locked position.
Figure 7B:
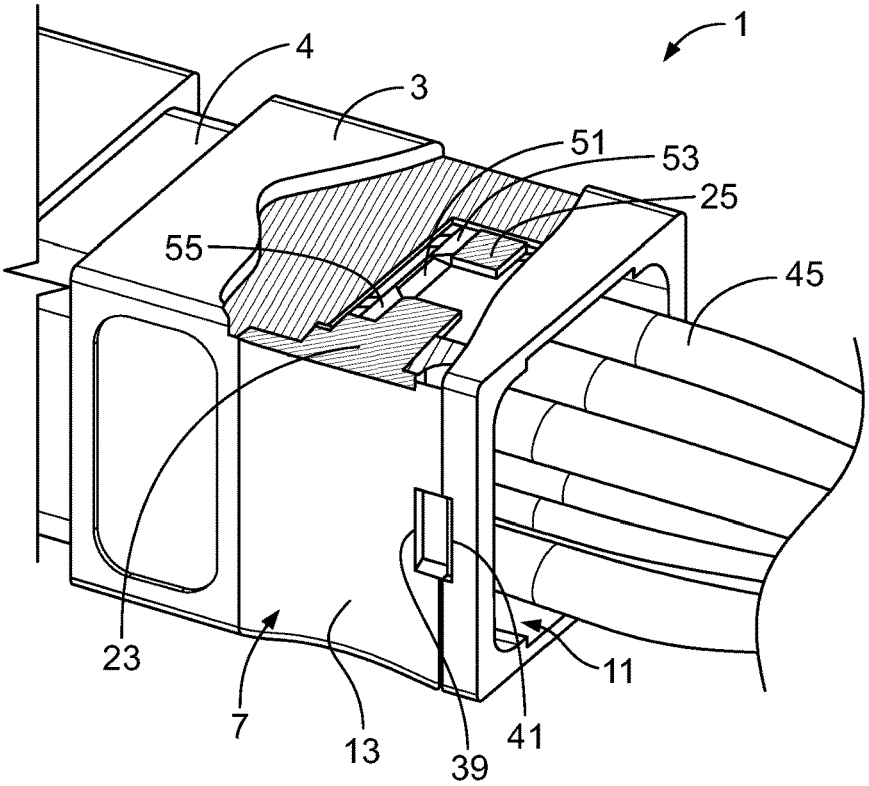
FIG. 7*b* is a sectional perspective view of the plurality of retention devices in the locked position.

In this locked position of FIG. 7 and as shown in FIG. 7*a*, the locking device 7 is held in the locked position by form-fit connection between the second longitudinal groove 29 of the connector pushing element 15 and the protruding element 33 of the housing 3. In the locked position shown in FIG. 7, the mating assistance device 1 allows the electrical connectors 43, 45 to be sealed according to the immersion at low air pressure requirement without external tools.

What is claimed is:

1. A mating assistance device, comprising:

a housing having an opening receiving an electrical connector in a direction of insertion; and a locking device movable between an unlocked position and a locked position with respect to the housing, the locking device having a connector pushing element displaceable in the direction of insertion when the locking device moves from the unlocked position to the locked position, the connector pushing element has a pair of protrusions protruding toward an inside of the housing when in the locked position, the pair of protrusions each have a shape complementary to a latch device disposed on an interface of the electrical connector and each engage the latch device to move the electrical connector in the direction of insertion;

wherein a trajectory of the connector pushing element from the unlocked position to the locked position is inclined with respect to a direction perpendicular to the direction of insertion.

2. The mating assistance device of claim 1, wherein the trajectory of the connector pushing element from the unlocked position to the locked position is inclined at an angle between 5° and 15° with respect to the direction perpendicular to the direction of insertion.

3. The mating assistance device of claim 1, wherein the locking device is a U-shaped bracket having a configuration conforming to a shape of the housing.

4. The mating assistance device of claim 3, wherein the U-shaped bracket has a central portion with an inner surface and a pair of arms extending from the inner surface.

5. The mating assistance device of claim 4, wherein the pair of arms extend from the inner surface in a direction inclined with respect to a direction extending normal from the inner surface.

6. The mating assistance device of claim 1, wherein the housing is a hollow beam with a pair of opened ends each adapted to receive a terminal of the electrical connector.

7. The mating assistance device of claim 6, wherein the housing is monolithically formed in a single piece from a molded plastic or a polymer material.

8. The mating assistance device of claim 1, further comprising a plurality of retention devices configured to hold the locking device in the unlocked position and in the locked position.

9. The mating assistance device of claim 8, wherein the retention devices provide a form-fit connection between the housing and the connector pushing element in the unlocked position and in the locked position.

10. The mating assistance device of claim 8, wherein the retention devices include a pair of longitudinal grooves on the connector pushing element and a protruding element of the housing configured to engage the longitudinal grooves.

11. The mating assistance device of claim 10, wherein the protrusion element protrudes toward the connector pushing element.

12. The mating assistance device of claim 1, wherein the locking device and/or the housing has a handle configured to permit pulling of the locking device from the locked position to the unlocked position.

13. The mating assistance device of claim 1, wherein the locking device and/or the housing has an opening with an undercut configured to permit unmating of the electrical connector by using an external tool.

14. The mating assistance device of claim 1, wherein the latch device includes a ramp disposed between a pair of wedges.

15. The mating assistance device of claim 14, wherein the pair of protrusions include a first protrusion and a second protrusion, the second protrusion is positioned between the wedges in the unlocked position.

16. The mating assistance device of claim 15, wherein the first protrusion and the second protrusion are each positioned behind one of the wedges in the locked position.

17. A method for connecting a plurality of electrical connectors each having an interface with a latch device, comprising the steps of:

providing a mating assistance device including a housing having a pair of opened ends and a locking device movable between an unlocked position and a locked position with respect to the housing, the locking device having a connector pushing element displaceable in a direction of insertion of the electrical connectors into the housing when the locking device moves from the unlocked position to the locked position, the connector pushing element has a pair of protrusions protruding toward an inside of the housing when in the locked position;

inserting a terminal of each of the electrical connectors into the housing through the opened ends in the direction of insertion; and pushing the locking device from the unlocked position to the locked position, the pair of protrusions each have a shape complementary to the latch device to thereby push the electrical connector toward a center of the housing in the direction of insertion by the connector pushing element following a trajectory from the unlocked position to the locked position that is inclined with respect to a direction perpendicular to the direction of insertion.

* * * * *